United States Patent [19]

Semouha

[11] Patent Number: 4,507,878

[45] Date of Patent: Apr. 2, 1985

[54] FASTENING MECHANISM

[76] Inventor: Hertzl Semouha, 280 Lindenshire, Exeter, N.H. 03833

[21] Appl. No.: 451,472

[22] Filed: Dec. 20, 1982

[51] Int. Cl.[3] ..... A43B 11/00; A43C 1/00; A43C 3/00

[52] U.S. Cl. ..... 36/50; 24/140; 24/68 SK

[58] Field of Search ..... 36/50; 24/140, 142, 24/147, 148, 68 SK

[56] References Cited

U.S. PATENT DOCUMENTS

| | | | |
|---|---|---|---|
| 178,449 | 6/1876 | Lindemann | 36/50 |
| 215,286 | 5/1879 | Noack . | |
| 354,668 | 12/1886 | Taylor | 24/140 |
| 680,711 | 8/1901 | Hembree | 24/140 |
| 749,569 | 11/1904 | Luks | 24/140 |
| 996,468 | 6/1911 | DeHaven | 24/140 |
| 1,020,511 | 3/1912 | Ricks | 24/140 |
| 1,057,382 | 3/1913 | Kramer | 24/140 |
| 1,196,216 | 8/1916 | Doredant et al. | 24/140 |
| 1,421,291 | 6/1922 | Nelson | 24/140 |
| 2,814,085 | 6/1954 | Peselnick | 24/140 |
| 2,867,878 | 4/1953 | Sundback | 24/205 |

FOREIGN PATENT DOCUMENTS

| | | | |
|---|---|---|---|
| 213894 | 6/1941 | Switzerland | 36/50 |

*Primary Examiner*—Werner H. Schroeder
*Assistant Examiner*—Steven N. Myers

[57] ABSTRACT

A fastening mechanism for joining together separable portions of an article including, for each portion, a track with sliders connected together by bridge connectors to limit the movement of the sliders along the track, the sliders and/or bridge connectors on opposite tracks being connected by adjustable lacing means.

18 Claims, 6 Drawing Figures

FASTENING MECHANISM

FIELD OF THE INVENTION

The invention relates to a fastening mechanism for easily and adjustably joining together separable portions of an article.

BACKGROUND OF THE INVENTION

Footwear and garments are typically provided with zipper, button, or lace fasteners to join together separable portions of the footwear or garments after they have been placed on the human body. For example, one would use a zipper fastener in an application where concerns are ease and speed in joining together the separable portions and there is no need for adjustability, and one would use a lace fastener when it is desired to adjust the distance between the separable portions.

Noack U.S. Pat. No. 215,286 discloses a quick shoelacing mechanism in which the lace is threaded through sliders on side tracks. When the lace is pulled, the sliders move up the tracks and cause two shoe pieces to move together. The ends of the lace are then secured in clasps.

SUMMARY OF THE INVENTION

I have discovered that separable portions of an article such as a shoe or an article of clothing can be adjustably and quickly joined together by providing, for each portion, a track with sliders connected together by bridge connectors to limit the movement of the sliders along the track, and by connecting the sliders and/or the bridge connectors on opposite tracks with a lace. In use, the separable portions can be easily brought together by moving the sliders away from each other on the tracks; the bridge connectors properly space the sliders along the track, causing the tension to be evenly distributed throughout the lace. The distance between the two separable portions (when they are fastened together) is adjusted to the proper amount when the lace is tied the first time; there is no need to unthread the lace or pull it through holes each time one wants to separate the portions or move them together, and each time that the pieces are fastened together, they are be automatically spaced by the same distance, with equal tension throughout the lace.

The lace can be connected between sliders on the different tracks and/or connected between bridge connectors that are flexible and are on the different tracks. In a most preferred embodiment, the lace is threaded around flexible bridge connectors, to permit the sliders to be compressed together along shorter lengths of the tracks, and to permit the separable portions to be separated by larger distances. In some preferred embodiments, the sliders have longitudinal cavities that fit around beaded tracks. In some other preferred embodiments the sliders are beaded to fit within longitudinal, enlarged cavities of the tracks, and the bridge connectors between adjacent sliders pass through holes in the sliders within the track cavities.

In addition to providing quick and adjustable fastening, the invention generally permits fastening to be done by only one hand, making it an ideal fastening mechanism for handicapped people.

DESCRIPTION OF THE PREFERRED EMBODIMENT

I will now describe the structure and use of the presently preferred embodiment of the invention, after first briefly describing the drawings.

DRAWINGS

STRUCTURE

Figure 1:
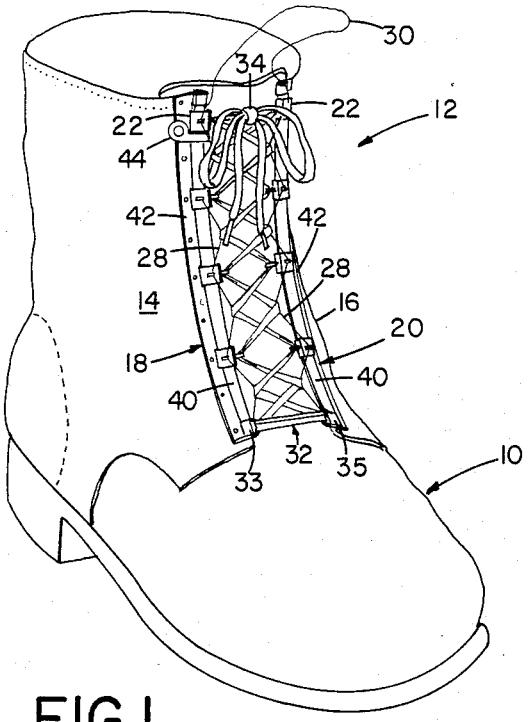
FIG. 1 is a perspective view of a boot incorporating a fastening mechanism according to the invention, separable portions of the boot being shown in a fastened position.
Figure 2:
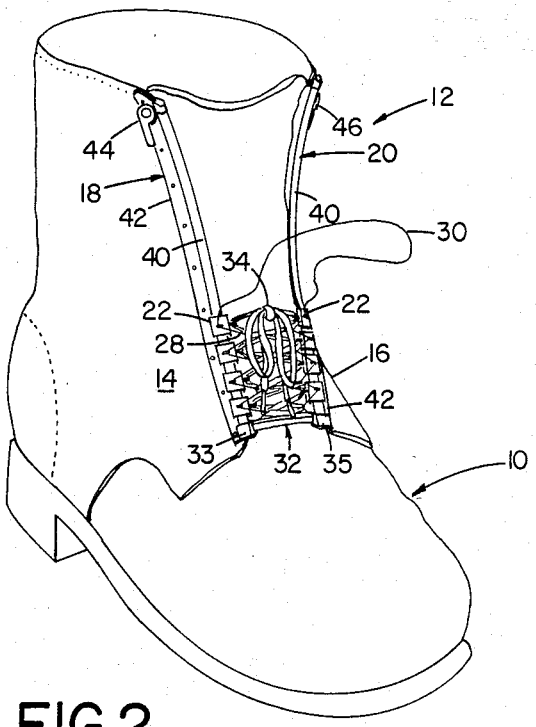
FIG. 2 is a perspective view of the FIG. 1 boot showing the separable portions in an unfastened position.
Figure 3:
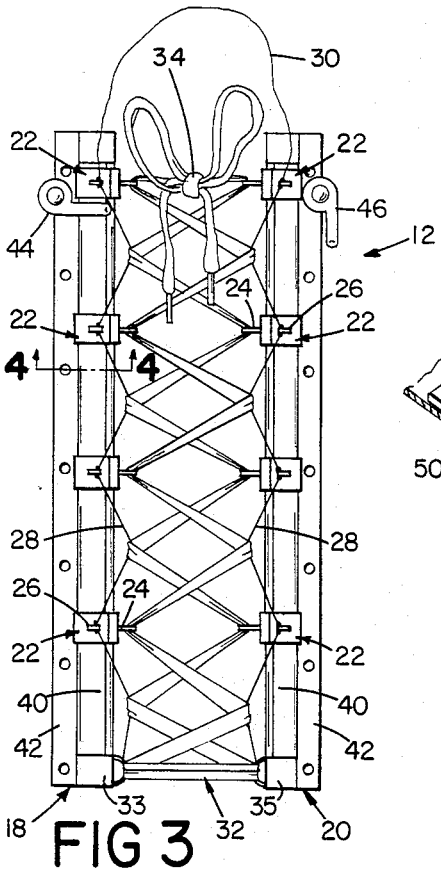
FIG. 3 is a plan view of the fastening components of the FIG. 1 boot.

Referring to FIGS. 1–4, there is shown boot 10 having fastening mechanism 12 for joining together separable portions 14, 16 of the boot. Mechanism 12 includes extruded plastic tracks 18, 20, connected to portions 14, 16, respectively. Slidably mounted on tracks 18, 20 are sliders 22, having lace eyelets 24 and flexible bridge eyelets 26. Referring particularly to FIG. 3, it is seen that adjacent sliders 22 along the same track are connected by flexible bridge connectors 28 (20 pound test thread that it knotted at eyelets 26), and that the thread that makes up connectors 28 forms a loop 30 between the top two sliders 22. Lace 32 is threaded between lace eyelets 24 of sliders 22 and around flexible bridge connectors 28. Lace 32 passes from a slider 22 on one track to a bridge connector 28 on the opposite track and then back to another slider 22 on the same track. Lace 32 passes through fixed eyelets 33, 35 connected to the bottoms of tracks 18, 20, and is tied together at knot 34 at the top.

Figure 4:
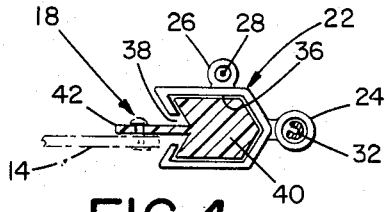
FIG. 4 is a sectional view, taken at 4—4 of FIG. 3, showing a slider and a track of the FIG. 1 boot.

Referring to FIG. 4, it is seen that each connector 22 has enlarged cavity 36 and restricted opening 38 to cavity 36. Each track 18 has bead 40 that is larger than restricted opening 38 and connecting portion 42 that is thinner than restricted opening 38 and passes through restricted opening 38 and is secured to shoe portion 14. Referring to FIG. 3, at the tops of tracks 18, 20 are latch means 44, 46 for locking the uppermost sliders 22 in position when they are at the tops of tracks 18, 20. Latch means 44 is shown in a locked position; latch means 46 is shown in an unlocked position.

USE

In use, the boot wearer starts with sliders 22 in the compressed position shown in FIG. 2. Knot 34 is untied, and portions 14, 16 are separated from each other while the wearer places his foot in boot 10. Loop 30 is then pulled upward to raise the uppermost sliders 22 to the tops of tracks 18, 20, and latch means 44, 46 are activated to lock the uppermost sliders 22 at the tops of the tracks. While sliders 22 are being raised along the tracks, bridge connectors 28 cause the sliders to be spaced along tracks 18, 20. Lace 32 is then tightened to bring portions 14, 16 together to the desired amount, and knot 34 is then retied, the boot appearing as in FIG. 1. To take boot 10 off, latching means 44, 46 are undone, and sliders 22 are simply slid together to the compressed position of FIG. 2. Thereafter when boot 10 is used again, portions 14, 16 are easily fastened by merely pulling on loop 30 and securing latches 44, 46. As sliders 22 slide up tracks 18, 20, portions 14, 16 are brought together because flexible bridge connectors 28 are pulled closer to tracks 18, 20. Portions of lace 32 also move from a generally horizontal position to a diagonal position, similarly causing portions 14, 16 to come together. Sliders 22 are automatically properly positioned along track 18, 20, owing to flexible bridge connectors 28. Also, flexible bridge connectors 28 make smaller angles with the longitudinal track axes than portions of lace 32, and thus overall normal, friction-producing forces on tracks 18, 20 are smaller than they would be if bridge connectors 28 were absent.

OTHER EMBODIMENTS

Other embodiments of the invention within the scope of the appended claims will become apparent to those in the art.

For example, lace 32 need not be connected to both sliders 22 and flexible bridge connectors 28, but can be connected to either flexible bridge connectors 28 alone or to sliders 22 alone.

Also, tracks 18, 20 could be made of other materials or of other constructions, and different slider and track mechanisms could be used. For example, in a most preferred embodiment, bridge eyelet 26 is provided directly in line with and behind eyelet 24 (FIG. 4), to reduce twisting forces on slider 22. Also, in FIGS. 5 and 6, another construction is shown. It involves track 48 and mating sliders 54. Track 48 has enlarged cavity 50 along its sliding axis and restricted opening 52. Each slider 54 has bead 56 that is larger than restricted opening 52 and lace connector 58 that is thinner than restricted opening 52. Flexible bridge connectors 60 pass through holes 62 in beads 56 of sliders 54, and thus pull on sliders 54 at or near the longitudinal axis to promote reduced-friction sliding.

Figure 5:
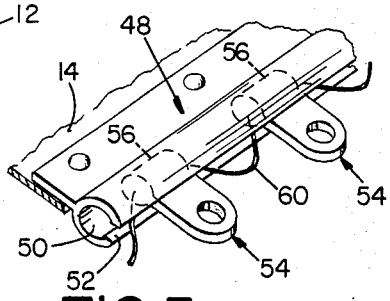
FIG. 5 is a perspective view of an alternative embodiment of a slider and track mechanism for the FIG. 1 boot.
Figure 6:
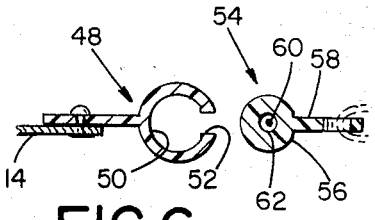
FIG. 6 is a sectional view of the slider and track components of the FIG. 5 mechanism shown separated from each other.

Also, in the FIGS. 5 and 6 embodiment, flexible bridge connector 60 could be replaced by bridge connectors that remain completely within cavity 50, to improve the appearance of the lacing mechanism, and to apply pulling forces to sliders 22 that coincide with the longitudinal axes of tracks 18, 20, to facilitate reduced-friction sliding.

What is claimed is:

1. A fastener for joining together two separable portions of an article, said fastener comprising a pair of tracks, each said track for being attached to a said separable portion and for being spaced from the track on the other said portion, lace securing means connected to said tracks comprising pairs of sliders, each slider of a pair being slidably mounted on a said track, and flexible tension-bearing substantially-inelastic cord-type bridge connectors attached between adjacent said sliders on the same said track such that they space said sliders along said track when the end sliders of said track are pulled away from each other, said bridge connectors being substantially inelastic along the directions of sliding along said tracks, said bridge connectors being free to move away from said tracks when said sliders are moving together, said bridge connectors being adapted to move without friction as said sliders move along said tracks, and adjustable lace means connected between said lace securing means on said sliders such that movement of said sliders together along said tracks permits said two separable portions to separate, and movement of said sliders away from adjacent sliders along said tracks causes said separable pieces to move together, said lacing means being adjustable to vary the distance between said separable portions when said sliders are spaced apart.

2. The fastener of claim 1 wherein said adjustable lace means is connected between sliders on different tracks.

3. A fastener for joining together two separable portions of an article, said fastener comprising a pair of tracks, each said track for being attached to a said separable portion and for being spaced from the track on the other said portion, lace securing means connected to said tracks comprising pairs of sliders, each slider of a pair being slidably mounted on a said track, and flexible tension-bearing substantially-inelastic cord-type bridge connectors attached between adjacent said sliders on the same said track such that they space said sliders along said track when the end sliders of said track are pulled away from each other, and adjustable lace means connected between said lace securing means on said sliders such that movement of said sliders together along said track permits said two separable portions to separate, and movement of said sliders away from adjacent sliders along said tracks causes said separable pieces to move together, said lacing means being adjustable to vary the distance between said separable portions when said sliders are spaced apart, said adjustable lace means being connected between bridge connectors on different tracks such that said flexible bridge connectors and associated lace means move into the space between said tracks when said sliders are in a moved-together position, whereby said separable portions are permitted to be opened wider.

4. The fastener of claim 1 wherein said bridge connectors are flexible, and said adjustable lace means is connected between bridge connectors and sliders on different tracks.

5. The fastener of claim 1 wherein each said slider has an enlarged cavity along a sliding axis and a restricted opening to said cavity, and each said track has a bead that is larger than said restricted opening and a connecting portion that is thinner than said restricted opening and extends through said restricted opening.

6. The fastener of claim 1 wherein each said track has an enlarged cavity along a sliding axis and a restricted opening to said cavity, and each said slider has a bead that is larger than said restricted opening and a lace means connector that is thinner than said restricted opening and extends through said opening.

7. The fastener of claim 6 wherein said bridge connector is flexible and is thinner than said restricted opening and passes through a hole in said bead.

8. The fastener of claim 6 wherein said bridge connectors are completely contained with said enlarged cavities.

9. The fastener of claim 1 further comprising latching means for latching the sliders at the same ends of said tracks when the sliders are in a position corresponding to when said separable portions are fastened together.

10. A shoe including a fastener for joining together two separable shoe portions, said fastener comprising a pair of tracks, each said track being attached to a said separable portion and being spaced from the track on the other said portion, lace securing means connected to said tracks comprising pairs of sliders, each slider of a pair being slidably mounted on a said track, flexible tension-bearing substantially inelastic cord-type bridge connectors attached between adjacent said sliders on the same said track such that they space said sliders along said track when the end sliders of said track are pulled away from each other, said bridge connectors being substantially inelastic along the directions of sliding along said tracks, said bridge connectors being free to move away from said tracks when said sliders are moving together, said bridge connectors being adapted to move without friction as said sliders move along said tracks, and adjustable lace means connected between said lace securing means on said sliders such that movement of said sliders together along said tracks permits said two separable portions to separate, and movement of said sliders away from adjacent sliders along said tracks causes said separable pieces to move together, said lacing means being adjustable to vary the distance between said separable portions when said sliders are spaced apart.

11. The shoe of claim 10 wherein said adjustable lace means is connected between sliders on different tracks.

12. A shoe including a fastener for joining together two separable shoe portions, said fastener comprising a pair of tracks, each said track being attached to a said separable portion and being spaced from the track on the other said portion, lace securing means connected to said tracks comprising pairs of sliders, each slider of a pair being slidably mounted on a said track, and flexible tension-bearing substantially-inelastic cord-type bridge connectors attached between adjacent said sliders on the same said track such that they space said sliders along said track when the end sliders of said track are pulled away from each other, and adjustable lace means connected between said lace securing means on said sliders such that movement of said sliders together along said tracks permits said two separable portions to separate, and movement of said sliders away from adjacent sliders along said tracks causes said separable pieces to move together, said lacing means being adjustable to vary the distance between said separable portions when said sliders are spaced apart, said adjustable lace means being connected between bridge connectors on different tracks such that said flexible bridge connectors and associated lace means move into the space between said tracks when said sliders are in a moved-together position, whereby said separable portions are permitted to be opened wider.

13. The shoe of claim 10 wherein said bridge connectors are flexible, and said adjustable lace means is connected between bridge connectors and sliders on different tracks.

14. The shoe of claim 10 wherein each said slider has an enlarged cavity along a sliding axis and a restricted opening to said cavity, and each said track has a bead that is larger than said restricted opening and a connecting portion that is thinner than said restricted opening and extends through said restricted opening.

15. The shoe of claim 10 wherein each said track has an enlarged cavity along a sliding axis and a restricted opening to said cavity, and said slider has a bead that is larger than said restricted opening and a lace means connector that is thinner than said restricted opening and extends through said opening.

16. The shoe of claim 10 wherein said bridge connector is flexible and is thinner than said restricted opening and passes through a hole in said bead.

17. The shoe of claim 10 wherein said bridge connectors are completely contained with said enlarged cavities.

18. The shoe of claim 10 further comprising latching means for latching the sliders at the same ends of said tracks when the sliders are in a position corresponding to when said separable portions are fastened together.

* * * * *